US006784613B2

(12) United States Patent
Tokioka et al.

(10) Patent No.: US 6,784,613 B2
(45) Date of Patent: Aug. 31, 2004

(54) NON-EVAPORATING GETTER, FABRICATION METHOD OF THE SAME, AND DISPLAY UNIT

(75) Inventors: Masaki Tokioka, Kanagawa (JP); Mitsutoshi Hasegawa, Kanagawa (JP); Kazuya Shigeoka, Kanagawa (JP); Yutaka Arai, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/219,315

(22) Filed: Aug. 16, 2002

(65) Prior Publication Data

US 2003/0038597 A1 Feb. 27, 2003

(30) Foreign Application Priority Data

Aug. 23, 2001 (JP) ..... 2001-252777

(51) Int. Cl.[7] ..... H01J 29/94; H01J 9/29; H01J 31/12

(52) U.S. Cl. ..... 313/553; 313/561; 313/495; 252/181.6

(58) Field of Search ..... 313/553, 481, 313/545, 546, 561, 495, 547; 445/41, 31; 417/48–51; 252/181.1–181.7

(56) References Cited

U.S. PATENT DOCUMENTS

| | | | | |
|---|---|---|---|---|
| 3,620,645 A | | 11/1971 | Della Porta et al. | 417/48 |
| 5,688,708 A | * | 11/1997 | Kato et al. | 445/25 |
| 6,027,686 A | * | 2/2000 | Takahashi et al. | 419/38 |
| 6,383,050 B1 | | 5/2002 | Ishikura et al. | 445/41 |
| 6,544,665 B2 | * | 4/2003 | Rigney et al. | 428/633 |
| 6,559,596 B1 | * | 5/2003 | Arai et al. | 313/553 |

FOREIGN PATENT DOCUMENTS

| | | | | |
|---|---|---|---|---|
| JP | 5-205662 | | 8/1993 | |
| JP | 2000-231893 | | 8/2000 | |
| JP | 2000-251656 | | 9/2000 | |
| JP | 2000-31588 | | 11/2000 | |
| JP | 2000311588 A | * | 11/2000 | H01J/7/18 |
| WO | 95/23425 | | 8/1995 | |

OTHER PUBLICATIONS

Barosi et al., "Zirconium–Aluminum Alloy . . . Lamps", Int'l. Vacuum Congr. 1974, Japan, J. Appl. Phys. Suppl. 2, Pt. 1, 1974.

* cited by examiner

*Primary Examiner*—Vip Patel
*Assistant Examiner*—Glenn Zimmerman
(74) *Attorney, Agent, or Firm*—Fitzpatrick, Cella, Harper & Scinto

(57) ABSTRACT

A non-evaporating getter maintains the adsorbability for the residual gases, and in addition, secures sufficient characteristics particularly even when it experiences a high-temperature and low-vacuum condition in the fabrication process of a display unit.

The non-evaporating getter includes a substrate having no function as a getter and a polycrystalline film arranged on the substrate which film contains Ti as the main component and has a host of voids in the interior thereof. A non-evaporating getter is made by forming a polycrystalline film containing Ti as the main component on the concavo-convex surface of the substrate which substrate has concavities and convexities on a surface thereof and has no function as a getter.

13 Claims, 6 Drawing Sheets

NON-EVAPORATING GETTER, FABRICATION METHOD OF THE SAME, AND DISPLAY UNIT

BACKGROUND OF THE INVENTION

1. Field of the Invention

The present invention relates to a getter which is able to maintain the vacuum by adsorbing the residual gases in a vacuum, in particular, a non-evaporating getter which is able to maintain the performance quality thereof over a long period of time even in the atmosphere tending to degrade the performance quality thereof, and a display unit equipped with such a non-evaporating getter.

2. Related Background Art

In general, the substance which can adsorb physically and chemically the residual gases in a vacuum is referred to as a getter. A material used as a getter is preferably a material that has a large speed of absorbing the residual gases in a vacuum and can maintain such a large adsorbing speed over a long period of time, for the purpose of maintaining the vacuum in which the getter is arranged over a long period of time as possible.

Conventionally, as such materials for getters, the elemental metals of Ba, Li, Al, Zr, Ti, Hf, Nb, Ta, Th, Mo, and V, and the alloys thereof have been known. Those getters, in which these elemental metals and alloys thereof are heated and evaporated in a vacuum to expose the neat metallic surfaces to which the residual gaseous components in the vacuum are adsorbed chemically, are referred to as evaporating getters. On the other hand, those getters, in which these metals and alloys thereof are heated in a vacuum to make the oxide layers to diffuse inward so that the metallic surfaces show up on the outermost surfaces at every time of heating to which surface the residual gases in the vacuum are adsorbed, are referred to as non-evaporating getters.

A non-evaporating getter is formed of an elemental metal substance containing Zr or Ti as the main component or an alloy containing these metals. Usually, in an actual usage, a film of these metals or alloys is formed on a substrate made of a stainless steel, nichrome, or the like, and the film is heated together with the substrate by means of energization heating or the like to make the gettering ability to be operative.

When a thin film of such an elemental metal as Zr or Ti is formed on a substrate made of a stainless steel, nichrome, or the like, according to a generally known method of vacuum evaporation or the like, however, extremely stable oxides are formed on the surface of the formed film at the instant of being exposed to the atmospheric air, and hence it is necessary to heat at the high temperatures 800 to 900° C. in a vacuum for the purpose of forming active surface (Japan. J. Appl. Phys. Suppl. 2, Pt. 1, 49, 1974). Furthermore, the reactions between the thin films of these elemental metals subjected to the activation operation and the residual gases in a vacuum usually take place at 200° C. or above, so that the thin films do not essentially show the gettering abilities around room temperature.

Consequently, a variety of improvements have hitherto been made in order to form a getter which is able to react with the residual gases in a vacuum at low temperatures so as to acquire a satisfactory gettering ability.

In the first instance, however, from the view point of cost, these improved getters unpreferably require labors in fabrication. In addition, there has been a drawback that the desired gettering characteristics cannot necessarily be maintained for a long period of time, depending on the environmental conditions under which it is used, since such a getter as is capable of exhibiting a satisfactory gettering ability at temperatures as low a's room temperature is inevitably reactive, that is, fast in deterioration.

SUMMARY OF THE INVENTION

An object of the present invention is to provide a non-evaporating getter which can maintain the adsorbability for the residual gases, and in addition, can secure satisfactory characteristics particularly even when it experiences a high-temperature and low-vacuum condition in the process of the display unit fabrication.

Another object of the present invention is to provide a non-evaporating getter having the above described performance by means of a dry and convenient method.

Yet another object of the present invention is to provide a display unit which incorporates a non-evaporating getter having the above described performance and being excellent in display performance.

A non-evaporating getter of the present invention is characterized in that it comprises a substrate having no function as a getter and a polycrystalline film arranged on the substrate which film contains Ti as the main component and has a host of voids in the interior thereof.

In addition, the fabrication method of a non-evaporating getter of the present invention is characterized in that a polycrystalline film containing Ti as the main component is formed on the concavo-convex surface of the substrate which substrate has concavities and convexities on the surface thereof and does not have a function as a getter.

In addition, the display unit of the present invention which is equipped in its envelope with electron sources and phosphors each arranged to be opposing to one electron source is characterized in that the above described non-evaporating getter is arranged in the envelope.

DETAILED DESCRIPTION OF THE PREFERRED EMBODIMENTS

Figure 1A:
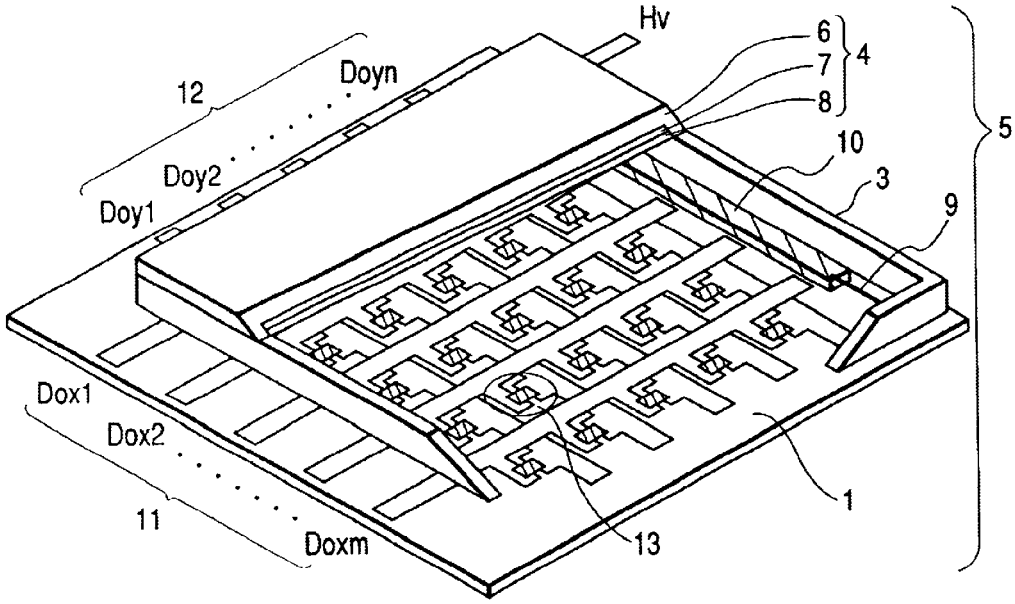
FIGS. 1A and 1B show an embodiment of an image display unit related to the present invention.

A first embodiment of the present invention is a non-evaporating getter characterized in that it comprises a substrate having no function as a getter and a polycrystalline film arranged on the surface thereof which film contains Ti as the main component and has a host of voids in the interior thereof.

In addition, the first embodiment of the present invention includes the preferable modes that the substrate has concavities and convexities on the surface on which surface the polycrystalline film is arranged, that the convexities of the above concavities and convexities have the average height within the range from 0.2 μm to 20 μm, that the average pitch between the convexities in the above concavities and convexities falls within the range from 0.5 μm to 20 μm, that the sizes of the crystal grains in the polycrystalline film fall within the range from 100 angstroms to 2000 angstroms, and that the polycrystalline film is composed of Ti.

A second embodiment of the present invention is a fabrication method of a non-evaporating getter which method is characterized in that a polycrystalline film containing Ti as the main component is formed on the concavo-convex surface of a substrate which substrate has concavities and convexities on the surface thereof and does not have a function as a getter.

The second embodiment of the present invention includes the preferable modes that the concavities and convexities are formed by a sand blast method, that the concavities and convexities are formed by a print method, that the convexities of the concavities and convexities have the average height within the range from 0.2 μm to 20 μm, that the average pitch between the convexities in the concavities and convexities falls within the range from 0.5 μm to 20 μm, that the substrate is a substrate containing nichrome as the main component, that the substrate is a substrate containing silver as the main component, and that the formation of a thin film containing Ti as the main component is formed by a sputtering method.

A third embodiment of the present invention is a display unit which is equipped in the envelope with electron sources and phosphors each opposing to one electron source is characterized in that the above described non-evaporating getter is arranged in the envelope.

The non-evaporating getter of the present embodiment, which getter comprises a substrate having no function as a getter and a polycrystalline film arranged on the substrate surface which film contains Ti as the main component and has a host of voids in the interior thereof, is fabricated by forming a polycrystalline film composed of Ti on the concavo-convex surface of a substrate made of nickel, silver, and the like and having no function as a getter which surface has concavities and convexities thereon.

The technique, with which the crystal grain size is controlled to fall within the range from 100 angstroms to 2000 angstroms in the polycrystalline film in a non-evaporating getter of the present embodiment, makes at least the average height along the lengthwise direction of the convexities of the concavities and convexities on the substrate surface to fall within the range from 0.2 μm to 20 μm, namely, makes such concavities and convexities that the average height from a concavity to a convexity falls within the range from 0.2 μm to 20 μm. Furthermore, it is preferable to make the average pitch along the lengthwise direction between the convexities of the concavities and convexities to fall within the range 0.5 μm to 20 μm.

A sand blast method or a print method is preferably used for such a control of the concavities and convexities on the substrate surface as described above, while a sputtering method is preferably used for the formation of a thin film containing Ti as the main component on such a substrate.

The non-evaporating getter of the present embodiment described above is a polycrystalline film containing Ti as the main component and having a host of voids in the interior thereof, and hence it is a getter which can maintain the adsorbability for the residual gases for a longer period of time as compared with a conventional non-evaporating getter of a thin film containing Ti as the main component. Concavities and convexities are formed on a substrate having no function as a getter, that is, on an ordinary substrate instead of a substrate having special functions, and a film is formed on such a concavo-convex surface. In this way, such a polycrystalline film having a host of voids in the interior thereof as described above can be formed, and hence an extremely low-cost fabrication is possible in the fabrication of an electron source or an image display unit.

Detailed description will be made below on the embodiments of a non-evaporating getter of the present invention, with reference to a display unit incorporating the getter.

A first example of the preferred embodiments of the present invention is a configuration in which a non-evaporating getter of thin Ti film, which film is arranged on a substrate made of nichrome or the like, is provided outside the image displaying region in an image display unit.

In this case, the thin Ti film is a polycrystalline Ti film having a host of voids in the interior thereof, and the sizes of the crystal grains of the polycrystalline film are made to fall within the range from 100 angstroms to 2000 angstroms.

Such a polycrystalline film in the present embodiment is arranged on a nichrome substrate in which the concavities and convexities on the surface thereof fall on average within the range from 0.2 μm to 20 μm, and the average pitch between the convexities falls within the range from 0.5 μm to 20 μm.

In other words, the thin Ti film of the present embodiment is formed by depositing Ti by means of a sputtering method on an concavo-convex surface of a nichrome substrate in which concavities and convexities are beforehand formed on the surface of the nichrome substrate by a sand blast method, a print method, or the like, in such a way that the concavities and convexities on the surface fall on average within the range from 0.2 μm to 20 μm, and the average pitch between the convexities falls within the range from 0.5 μm to 20 μm.

Figure 1B:
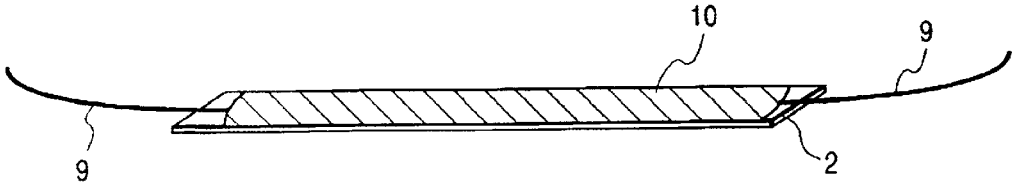

FIG. 1A shows a schematic view of a flat panel image display unit in which non-evaporating Ti getters are arranged. As FIG. 1A shows, an electron source substrate 1 is provided with a number of electron emitting devices 13, which substrate forms an envelope 5, together with a supporting frame 3 and a face plate 4. The construction of the electron source substrate 1 will be described later. In the face plate 4, a phosphor screen 7 and a metallic back 8 are formed on a glass substrate 6. The display unit configuration allows row selection terminals 11 and signal input terminals 12 to be accessible from the outside of the envelope 5, and the electron emitting devices 13 can be driven by applying the signals through these terminals. The emitted electrons are accelerated by use of a high voltage terminal Hv, and are made to collide against the phosphor screen 7 to display the image. The so-called image display region is the electron colliding portion of the region where are the phosphor screen 7 and the metallic back 8 in the face plate 4. As FIG. 1B shows, a non-evaporating getter of thin Ti film 10 is formed on a nichrome substrate 2, and fixed to a supporting frame 3 together with the nichrome substrate by use of a getter supporting member 9. Although in FIG. 1A a non-evaporating getter of thin Ti film 10 is depicted only along an edge outside the image display region, a non-evaporating getter of thin Ti film 10 may be arranged along any one of the four edges outside the image display region, or it may be arranged along an arbitrary plurality of edges of the four edges.

A second preferred embodiment of the present invention is an embodiment in which the above described thin Ti film is formed directly on a member in the image display region, and a detailed description of the embodiment will be made below with reference to FIG. 2.

Figure 2:
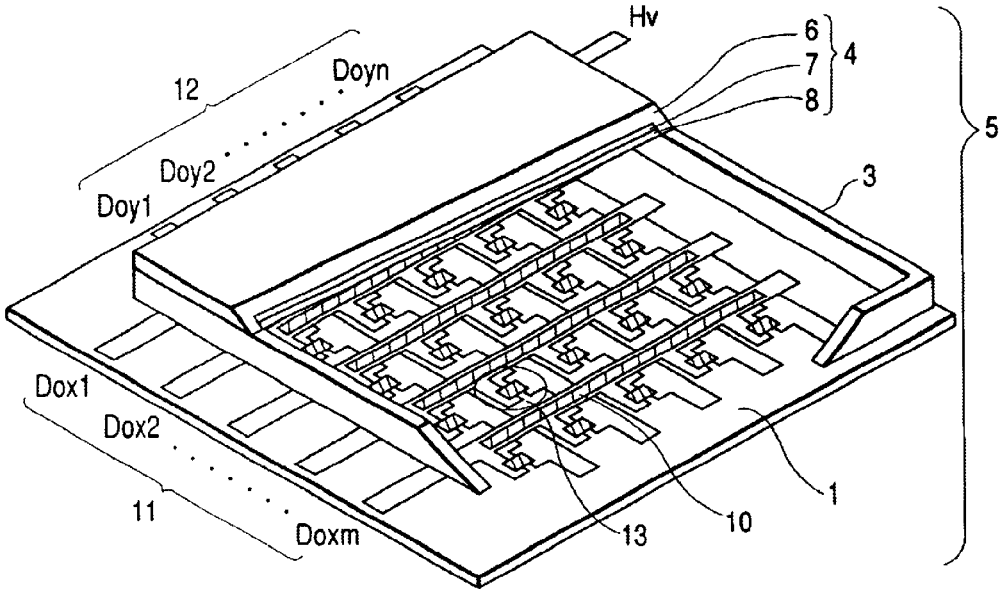
FIG. 2 shows another embodiment of an image display unit related to the present invention.

In FIG. 2, those members having the same reference numerals or symbols as in FIGS. 1A and 1B denote the same members as in FIGS. 1A and 1B. As FIG. 2 shows, non-evaporating getters are formed on x-directional wires Dox1 to Doxm in the image display region, which wires containing silver as the main component, and in which region the thin Ti films 10 being formed and lying astride. In this case, similarly to the case of the nichrome substrate, the x directional wires Dox1 to Doxm, which wires forming the substrates for the thin Ti films, have the concavities and convexities on the surfaces thereof falling within the range from 0.2 $\mu$m to 20 $\mu$m with the average pitch between the convexities falling within the range from 0.5 $\mu$m to 20 $\mu$m. In the present embodiment, such concavities and convexities are also formed beforehand on the surfaces of the x directional wires Dox1 to Doxm when the thin Ti films 10 are formed. In the actual formation of the concavities and convexities, the x directional wires Dox1 to Doxm are formed, and subsequently the surfaces thereof are processed by a sand blast method, or by use of a printing paste composition containing silver, the calcination conditions, or the like being controlled when the x directional wires Dox1 to Doxm are formed.

If a non-evaporating getter of thin Ti film 10, which film being a conductive material, is deposited outside the desired portion (here the desired portion is a wiring portion), short circuiting may possibly be caused. Accordingly a precaution is required in fabrication, as such that a metallic mask having openings matched with the wiring patterns is prepared, the positioning of the mask is made carefully, and the thin Ti film 10 is formed by a sputtering method or the like.

Figure 3:
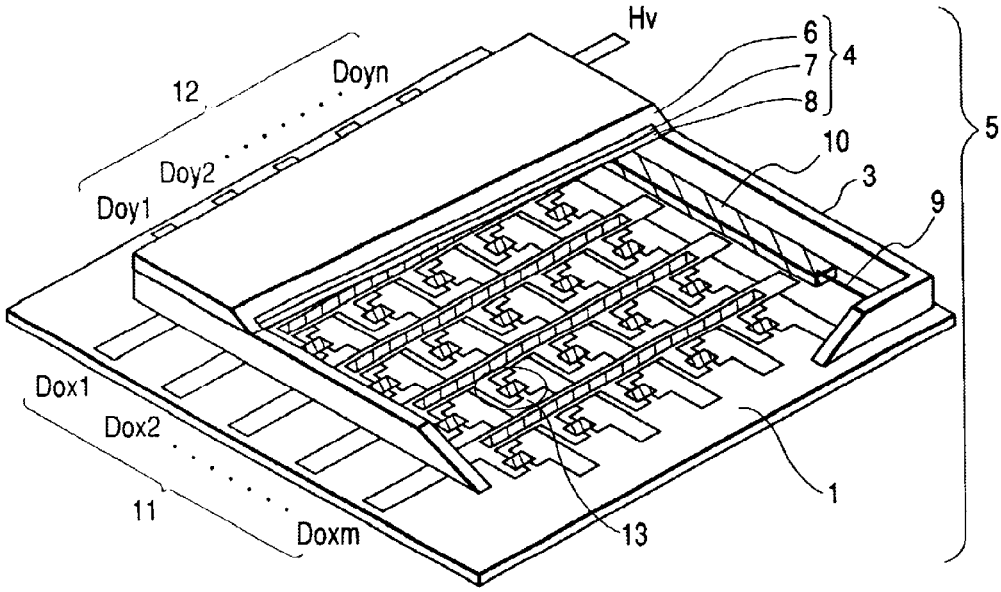
FIG. 3 shows yet another embodiment of an image display unit related to the present invention.

A third preferred embodiment of the present invention is a configuration in which a non-evaporating getter of thin Ti film is arranged both within and without the image displaying region in an image display unit. FIG. 3 illustrates a configuration in which the non-evaporating getters of thin Ti films 10 are arranged on an outside edge of the image displaying region and on the x directional wires Dox1 to Doxm within the image displaying region. Although in FIG. 3, as far as the region outside the image displaying region is concerned, a non-evaporating getter of thin Ti film is depicted only along an edge outside the image display region, a non-evaporating getter of thin Ti film may be arranged along any one of the four edges outside the image display region, or it may be arranged along an arbitrary plurality of edges of the four edges. As described above, a non-evaporating getter of thin Ti film 10 arranged within the image displaying region is fabricated so attentively that no short circuiting is caused.

Then, with reference to the image display unit shown in FIG. 3 as a representative example, a fabrication method thereof will be described below.

At the beginning, an envelope 5 shown in FIG. 3 is fabricated.

As for the array of the electron-emitting devices on the electron source substrate 1 composing the envelope 5, a variety of arrays can be adopted. In the electron source substrate shown in FIG. 3, a passive matrix arrangement is illustrated as an array of electron source devices. In a passive matrix array, a plurality of electron source devices are arranged both along the x direction and along the y direction to form a matrix shape, with a plurality of electron emitting devices on one and the same row each being connected through one of the two electrode to a common x-directional wire, and a plurality of electron emitting devices on one and the same column each being connected through the other electrode to a common y-directional wire.

In the electron source substrate 1 shown in FIG. 3, m strings of x-directional wires are composed of Dox1 to Doxm, and can be formed with electroconductive metallic substances prepared by a vacuum evaporation method, a print method, a sputtering method, or the like. The material, film thickness, and width of the wires are designed appropriately. The y-directional wires are composed of the n strings of Doy1 to Doyn and are formed similarly to the x-directional wires. There is provided an insulation layer, not shown in the figure, between the layer of the m strings of x-directional wires and the layer of the n strings of y-directional wires, and thereby the two layers of wires are separated electrically (both m and n are positive integers).

The interlayer insulation layer, not shown in the figure, is constructed with a layer of $SiO_2$ or the like formed by use of a vacuum evaporation method, a print method, a sputtering method, or the like. For example, the interlayer insulation layer is formed on the whole area or on a portion of the electron source substrate 1 having a layer of x-directional wires formed thereon. Particularly, the thickness, material, and fabrication method of the insulation layer are so appropriately designed that the insulation layer can bear with the voltage differences at the crossing portions of the x-directional and y-directional wires. The x-directional and y-directional wires are accessible through the external terminals 11 and 12, respectively.

An electron-emitting devices 13 is a surface conduction electron-emitting device comprising a pair of device electrodes arranged in parallel with a certain interval and an electroconductive film containing an electron-emitting region interposed between the pair of electrodes. A pair of device electrode (not shown in the figure) are electrtically connected to the m strings of x-directional wires and n strings of y-directional wires through connection wires made of an electroconductive metal or the like. In the above described configuration, individual devices can be selected and operated independently by means of a passive matrix wiring scheme.

The non-evaporating getters of thin Ti film 10 of the first embodiment are arranged on the x-directional and y-directional wires. When a thin Ti film is formed by means of a sputtering method or the like, a metallic mask having openings matched with the wiring patterns or the like is used so carefully that the getter may not be deposited on the undesired portions.

Successively, a second non-evaporating getter of the thin Ti film 10 formed on a nichrome substrate is arranged outside the image display region. The nichrome substrate, on which the second non-evaporating getter of thin Ti film is formed, is cut out according to the substrate size, and one end of the getter supporting member 9 and the nichrome substrate with the thin Ti film 10 arranged thereon are fixed to each other by the spot welding method or the like, while the other end of the getter supporting member 9 is fixed to the supporting frame 3 with frit glass or the like.

Now, description will be made on the face plate 4 of the envelope 5 shown in FIG. 3.

Figure 4A:
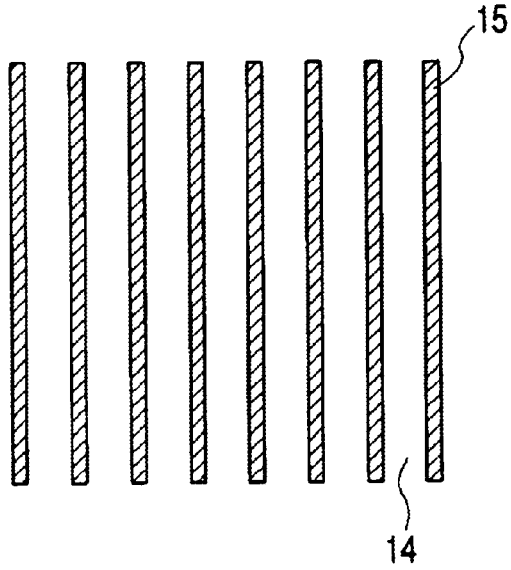
FIGS. 4A and 4B show a phosphor screen used in an image display unit related to the present invention.
Figure 4B:
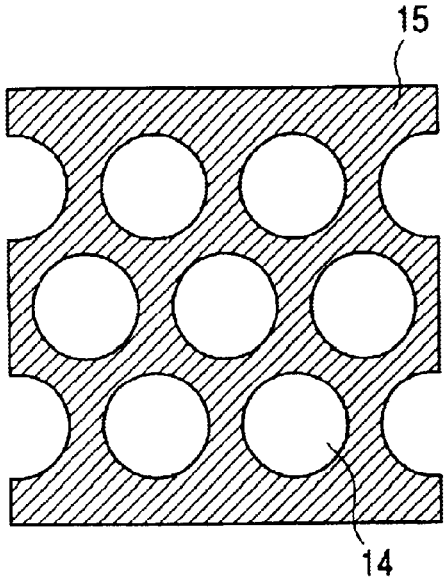

FIGS. 4A and 4B show schematically a phosphor screen used in an image display unit shown in FIG. 3. A phosphor screen 7 for a monochrome mode can be formed using only phosphors. A phosphor screen for a color mode can be formed with a black electroconductive 14, referred to as a black stripe or a black matrix depending on the phosphor array scheme, and a phosphor 15. The purposes for which the black stripe or black matrix is provided are to make the color mixing and the like to be unnoticeable by blackening the boundaries between the phoshors for three primary colors 15, and to suppress the contrast degradation in the phosphor screen 7 due to the reflection of the external light. As for the materials for black stripe, in addition to the conventional material containing graphite as the main component, there can be used such a material that is electroconductive and low in light transmittance and light reflection. Furthermore, the face plate 4 may be provided with a transparent electrode (not shown in the figure) on the outer surface of the phosphor screen 7 for the purpose of increasing the electroconductivity of the phosphor screen 7.

The electron source substrate 1 thus fabricated and the face plate 4 are bonded to each other with the supporting frame 3 interposed therebetween by seal bonding to form the envelope 5. During seal bonding, careful positioning is indispensable for the case of a color display to meet the requirement that the individual color phosphors and the electron-emitting devices be made to properly correspond to each other in position. Incidentally, when a supporting member, referred to as a spacer and not shown in the figure, is placed between the face plate 4 and the electron source substrate 1, there can be constructed an envelope 5 which has a sufficient strength against the atmospheric pressure.

Figure 5:
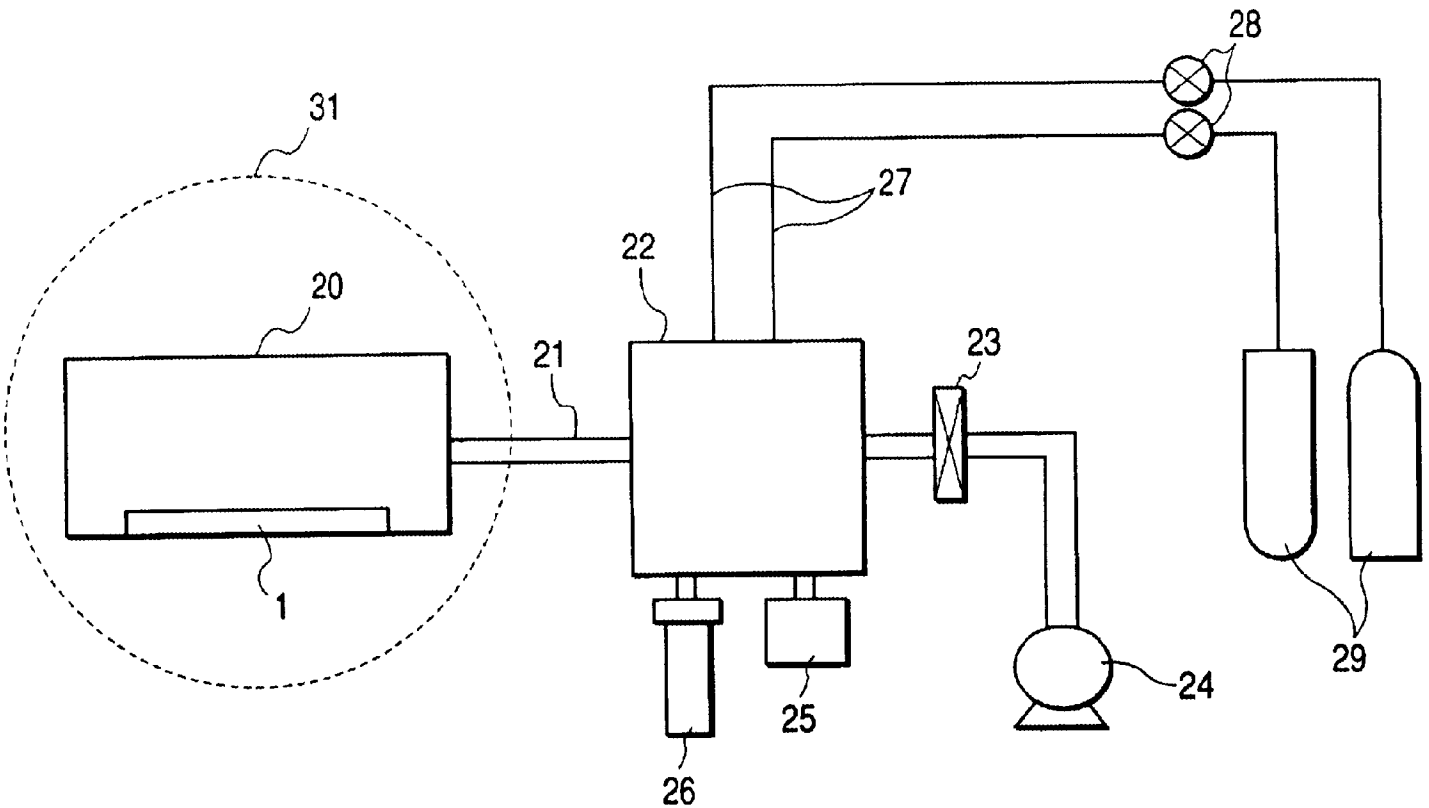
FIG. 5 shows a schematic diagram of a vacuum processing apparatus used in fabricating an image display unit related to the present invention.

In the next step, necessary processing is applied to the envelope 5 by means of the apparatus schematically shown in FIG. 5.

An image display unit 20 is connected to a vacuum chamber 22 through an evacuation pipe 21, and further connected to an evacuation unit 24 through a gate valve 23. The vacuum chamber 22 is equipped with a barometer 25 and a quadrupole mass spectrometer 26, and the like, for the purpose of measuring the internal pressure of the chamber and determining the partial pressures of the individual components in the atmosphere. Since it is difficult to measure directly the internal pressure of the envelope 5 of the image display unit 20, the pressure in the interior of the vacuum chamber 22 or the like is measured to control the processing conditions. Furthermore, gas introduction lines 27 are connected to the vacuum chamber 22, for the purpose of controlling the atmosphere by introducing needed gases into the vacuum chamber. The sources 29 for materials to be introduced are connected to the other ends of the gas introduction lines, in which sources the materials to be introduced are stored in ampoules or steel cylinders. A gas introduction control device 28 for controlling the introduction rate of a material being introduced is arranged in a midway portion of the gas introduction line. As the device controlling the introduction quantity, there can be used a variety of controllers depending on the material being introduced, specifically such as a slow leak valve or the like capable of controlling the leaking flux, a mass flow controller, and the like.

The interior of the envelope 5 is evacuated by means of the apparatus shown in FIG. 5, and the electron-emitting regions are formed, for example, by energization forming operation. By successively applying a train of pulses (scrolling) with successive phase shifts to the plurality of x-directional wires, the forming can be made en bloc for those electron-emitting devices connected to the plurality of x-directional wires.

Subsequently to the forming, an activation processing is applied. After a sufficient evacuation, an organic material is introduced into the envelope 5 through the gas introduction line 27. By applying voltage to each electron-emitting device in an atmosphere including an organic material, carbon or carbon compounds, or a mixture both thereof is deposited on the electron-emitting regions and the electron-emitting rate is drastically increased. The voltage applying manner of this case can be such that, using the wiring similar to that in the above forming, simultaneous voltage pulses are applied to the electron-emitting devices connected to a directional wire.

Subsequently to the completion of the activation processing, a stabilization processing is preferably performed, similarly to the case of the individual devices. While the envelope 5 is heated and maintained at the temperatures from 250 to 350° C., the envelope 5 is evacuated by use of a non-oil evacuation unit 24 such as an ion pump, an sorption pump, or the like, through the evacuation pipe 21, and is made to have an atmosphere sufficiently scarce in organic matters. Meanwhile, the non-evaporating getter of thin Ti film 10 arranged in the image display unit 20 is also heated to be activated so that its evacuation ability becomes highly operative. Then, the evacuation pipe is melted and sealed off by heating with a burner.

EXAMPLES

With reference to specific Examples, detailed description will be made below on the present invention. The present invention, however, is not limited to these Examples, but it includes those substitutions of the individual elements and those modifications and variations in design which fall within the scope where the objects of the present invention can be achieved.

Example 1

The image display unit of the present Example has a configuration similar to that in the unit schematically shown in FIG. 2, in which configuration a non-evaporating getter of thin Ti film is arranged on the x-directional wires (the upper layer wires) formed by a print method. In addition, the image display unit of the present example comprises an electron source in which a plurality (100 rows×300 columns) of surface conduction electron-emitting devices are wired as the electron-emitting devices in a passive matrix manner on the substrate.

At the beginning, a fabrication method of the electron source substrate will be described below with reference to FIGS. 6A, 6B, 6C, 6D, 6E, and 6F.

Process-a

A glass substrate 51 was rinsed sufficiently well with a detergent, pure water, and an organic solvent, on which substrate a silicon oxide film of 0.5 $\mu$m in thickness was formed by a sputtering method to make an electron source substrate.

Figure 6A:
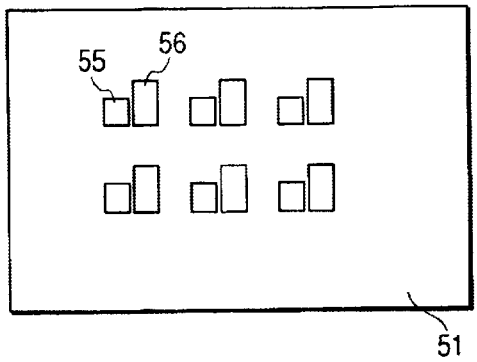
FIGS. 6A, 6B, 6C, 6D, 6E, and 6F show schematic views for illustrating a fabrication method of an electron source substrate for use in an image display unit related to the present invention.

The patterns to be device electrodes 55 and 56, and that to be a gap G between the device electrodes were formed by use of a photoresist (RD-200N-41, Hitachi Chemical Co., Ltd., Japan), and a Ti layer of 5 nm in thickness and a Ni layer of 100 nm in thickness were successively deposited by applying a vacuum evaporation method. The photoresist patterns were dissolved by use of an organic solvent, and the Ni/Ti deposited film was lifted off to form the device electrodes 55 and 56 each having a width of 300 $\mu$m with the gap G between the electrodes of 3 $\mu$m (FIG. 6A).

Process-b

Figure 6B:
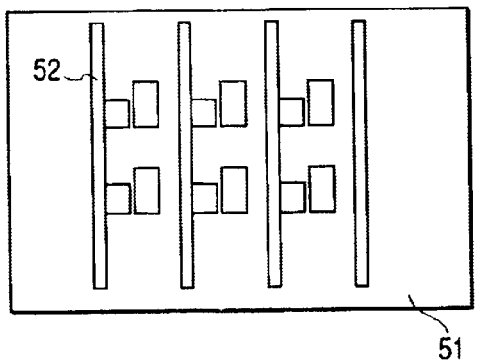

Then, by use of a screen printing method, silver wires were formed to be in contact with one side of each of the electrodes 55, and calcination was made at 400° C. to form a desired shape of lower layer wires 52 (FIG. 6B).

Process-c

Figure 6C:
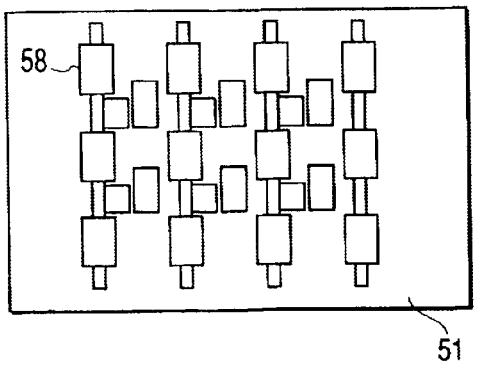

Then, by use of a screen printing method, a desired interlayer insulation layer 58 was printed on the crossing portions between the lower layer and upper layer wires, and calcination was made at 400° C. to form an interlayer insulation layer 58 (FIG. 6C).

Process-d

Figure 6D:
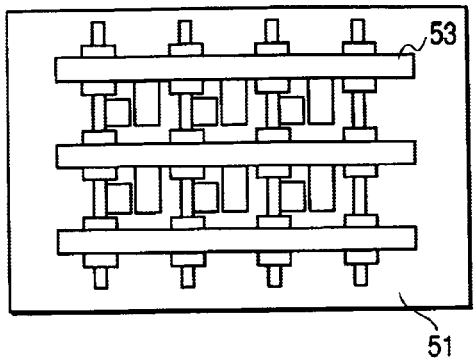

By use of a screen printing method, silver wires were printed so as to be in contact with the device electrodes 56 which were not in contact with the lower layer wires, and calcination was made at 400° C. to form the upper layer wires 53 (FIG. 6D).

Process-e

Figure 6E:
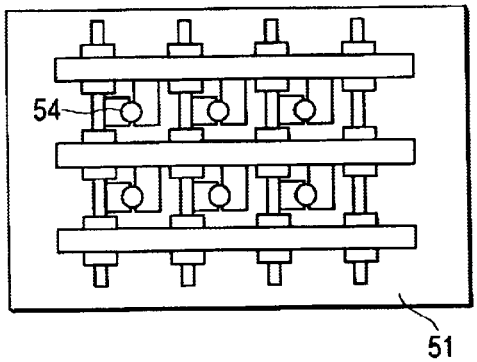
Figure 6F:
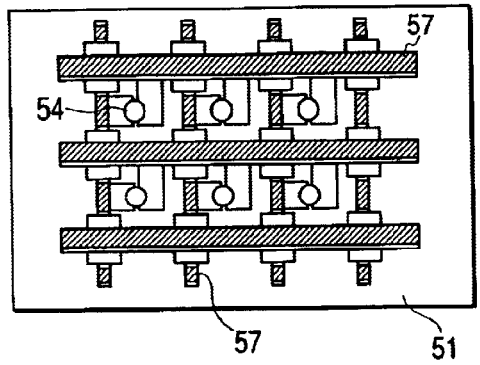

A Cr film of 100 nm in thickness was deposited and patterned by use of a vacuum evaporation method, a solution of a Pd amine complex (ccp4230, Okuno-Seiyaku, Inc., Japan) was applied onto the Cr film in a spin coating mode by use of a spinner, and calcinations was made at 300° C. for 10 min. An electroconductive film 54 thus formed for use in formation of the electron-emitting region comprising fine grains containing Pd as the main elemental substance was 8.5 nm in thickness and $3.9\times10^4$ Ω/□ in sheet resistance. The fine grain film referred to above is a film in which a plurality of fine grains are aggregated, and the microscopic structure of the film takes not only such a state that some individual fine grains are separately dispersed, but also such a state that some other fine grains are abutting to each other or overlapped on each other (inclusive of island shaped aggregates). Accordingly, the grain diameter is referred to the diameter of a fine grain recognizable in grain shape, as in the former state described above. The Cr film and the electroconductive film 54 subjected to calcination for use in formation of the electron-emitting regions underwent etching with an acid etchant to form a desired pattern (FIG. 6E).

Through all the above described processes, there was made an electroconductive film 54 for use in formation of a plurality (100 rows×300 columns) of electron-emitting regions which film was connected to a passive matrix array composed of a lower layer wires 52 and the upper layer wires 53 on an electron source substrate.

Process-f

A nichrome substrate of 50 μm in thickness, 2 mm in width, and 100 mm in length was prepared, which nichrome substrate underwent a sand blast processing to form the desired concavities and convexities on the surface thereof, and subsequently underwent a sputtering processing to form a Ti film of about 2.5 μm in thickness on the same surface. Thus, there was fabricated a non-evaporating getter 57 with a thin Ti film formed on the concavo-convex surface of the nichrome substrate. As already described by referring to FIGS. 1A and 1B, the non-evaporating getters 57 were arranged on the x-directional wires and fixed to a supporting frame 3 by use of fixing jigs.

Through all the above described processes, there was formed an electron source substrate provided with non-evaporating getters.

Process-i

Then, a face plate 4 shown in FIG. 2 was fabricated as follows. A glass substrate 6 was rinsed sufficiently well with a detergent, pure water, and an organic solvent. On the substrate, a phosphor screen was formed by coating with a print method and underwent a surface smoothing processing (usually referred to as "filming") to form a phosphor member. In particular, the phosphor screen 7 was the one in which stripe shapes of phosphors (R, G, B) 14 and black stripes 15 were alternately arranged as shown in FIG. 4A. Furthermore, a metallic back 8 of thin Al film of 0.1 μm in thickness was formed on the phosphor screen 7 by means of a sputtering method.

Process-j

Then, an envelope 5 shown in FIG. 2 was fabricated as follows.

The electron source substrate 1 fabricated in the previous process was fixed to a reinforcing plate (not shown in the figure), and then combined with the face plate 4 and a supporting frame 3 to which a non-evaporating getter of thin Ti film 10 was fixed. The lower layer wires 52 and the upper layer wires 53 on the electron source substrate 1 were connected to the row selection terminals and the signal input terminals, respectively. The electron source substrate 1 and the face plate 4 were strictly adjusted in relative positions, and then fixed to each other in a seal bonding manner to form an envelope 5. The seal bonding method was such that frit glass was applied onto the junction portions, and a thermal treatment at 450° C. for 30 min in Ar gas formed the junctions. Incidentally, a similar procedure was applied to the fixing of the electron source substrate 1 to the reinforcing plate.

Subsequently, the following processing was made by use of a vacuum apparatus shown in FIG. 5.

Process-k

The interior of the envelope 5 was evacuated to reduce the pressure thereof to $1\times10^{-3}$ Pa or below, and the electroconductive film 54 for use in formation of the plurality of electron-emitting regions arranged on the electron source substrate 1 was subjected to the following processing (referred to as "forming") for the purpose of forming the electron-emitting regions.

Figure 7:
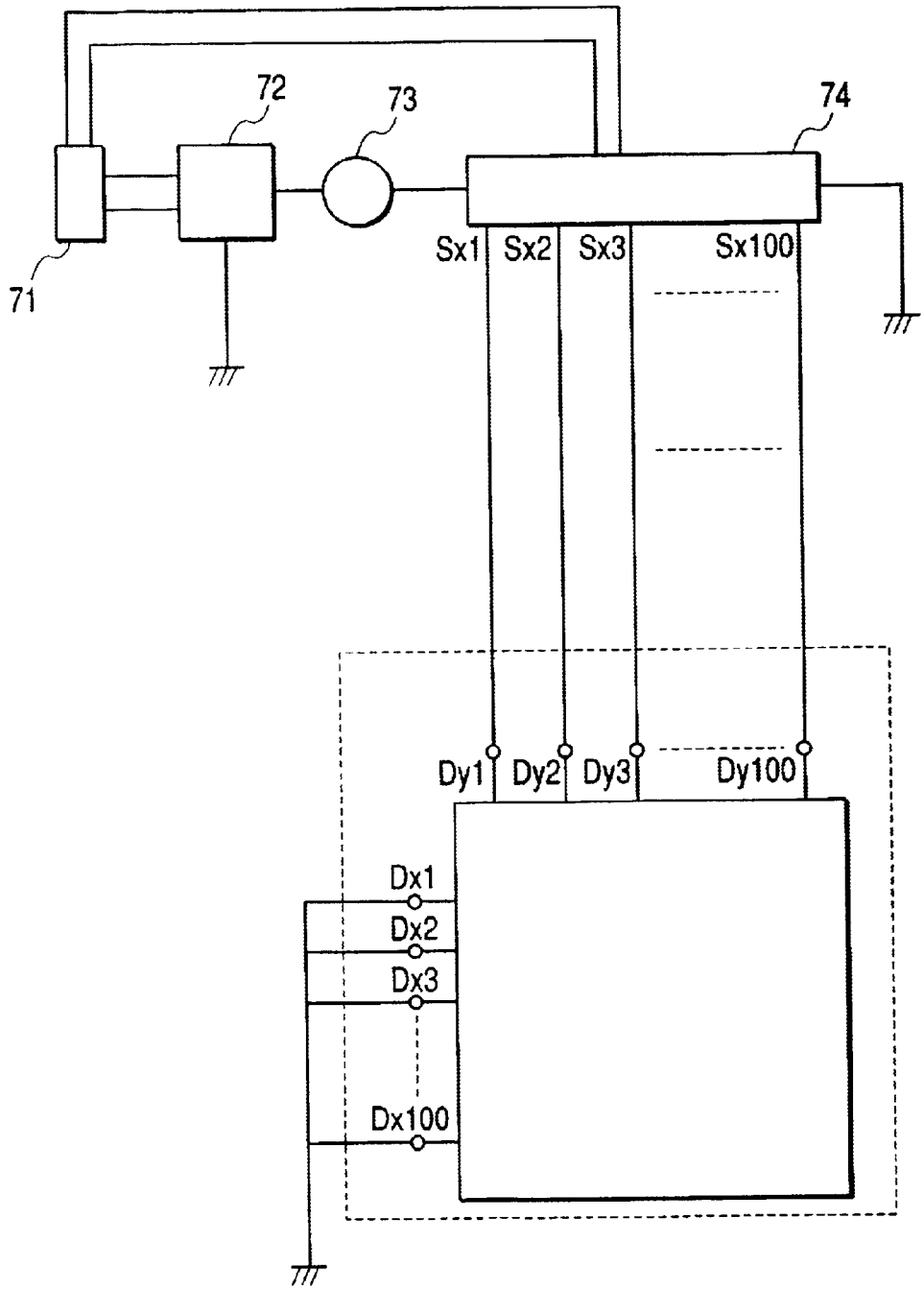
FIG. 7 shows a schematic diagram for illustrating a fabrication estimation apparatus for use in fabricating an image display unit related to the present invention.
Figure 5:
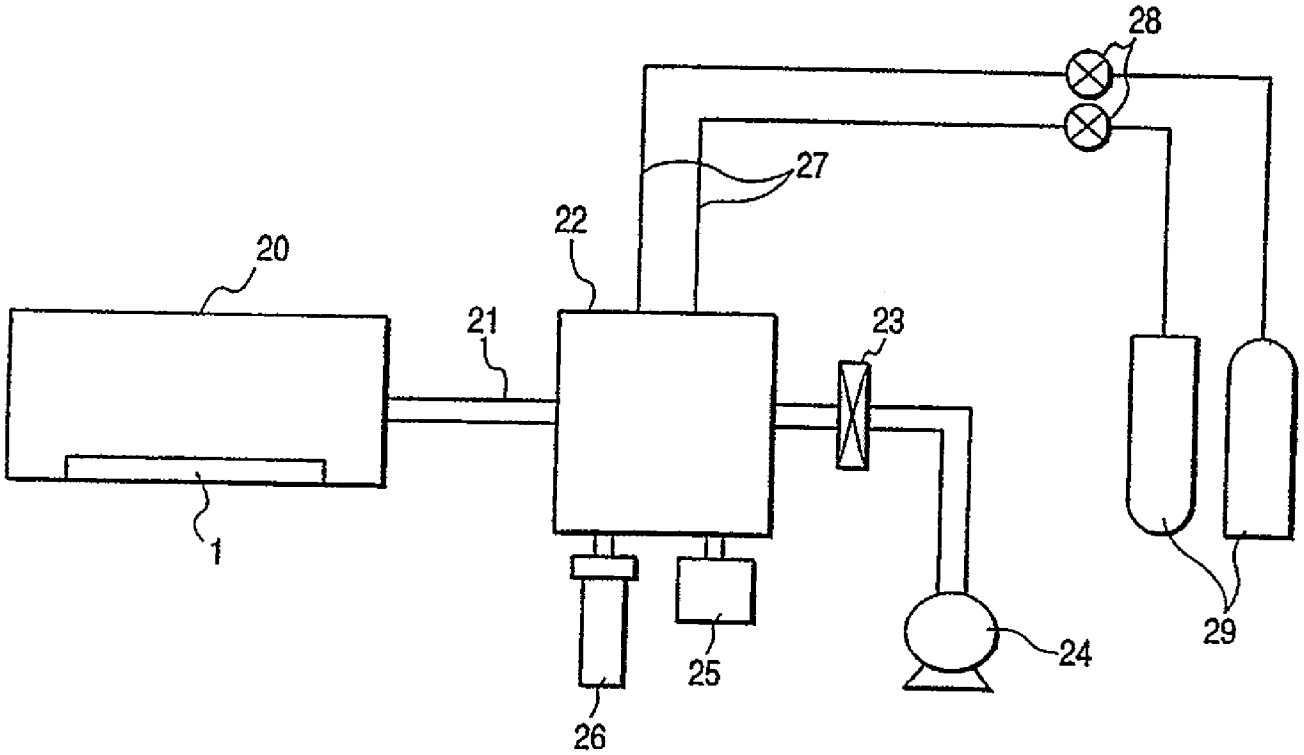

As FIG. 7 shows, the x-directional wires Dx1 to Dx100 were commonly connected to the ground. The reference numeral 71 refers to a control unit which controlled a pulse generator 72 and a line selection unit 74. The reference numeral 73 refers to an ammeter. The line selection unit 74 selected one line from the y-directional wires Dy1 to Dy100, to which line a pulse voltage was applied. The forming processing was applied to the y-directional row of devices in a one row (300 devices) by one row manner. The shape of the applied pulses was of a triangular pulse, and the pulse height was made to be gradually increased. The pulse width T1 was 1 msec and the pulse interval T2 was 10 msec. A rectangular pulse of 0.1 V in height was interposed between triangular pulses to determine the resistance of each row by measuring the current. When the resistance exceeded 3.3 kΩ (1 MΩ per a device), the forming of the row was finished, and the forming was moved to the next row. This sort of processing was applied to all the rows, and the forming of all the electroconductive films (the electroconductive films 54 for use in forming the electron-emitting regions) was completed to form an electron-emitting region on each electroconductive film, and there was fabricated an electron source substrate 1 in which a plurality of surface conduction electron-emitting devices were wired in a passive matrix manner.

Process-l

The benzonitrile beforehand stored in one of the material sources 29 was introduced into the vacuum chamber 22 shown in FIG. 5. The pressure was adjusted to $1.3\times10^{-3}$ Pa, and a pulse voltage was applied to the electron source while the device current If being measured, to activate each electron-emitting device. The pulse form generated by the pulse generator 72 was rectangular, and the pulse height, width T1, and interval were 14 V, 100 μsec, and 167 μsec, respectively. By use of the line selection unit 74, the selected line was switched at every 167 μsec successively from Dx1 to Dx100 so that a rectangular wave of T1=100 μsec and T2=16.7 msec was applied to each row of devices with the phases successively shifted by a small amount from row to row.

The ammeter 73 was used on a mode capable of detecting the average current for the on-state of the rectangular pulse (the state in which the voltage was 14 V). When the current thus measured reached 600 mA (2 mA per a device), the activation operation was finished and the interior of the envelope 5 was evacuated.

Process-m

While continuing evacuation, by use of a heating unit not shown in the figure, both the image display unit 20 and the vacuum chamber 22 were as a whole maintained at 300° C. for 10 hours. Through this procedure, there were removed the benzonitrile and decomposition substances therefrom supposed to be adsorbed on the interior wall of the envelope 5 and that of the vacuum chamber 22, as was confirmed by the observation based on a Q-mass 26.

In this processing, by virtue of maintaining the image display unit in a heated/evacuated state, not only the evacuation of the interior gases was performed, but also the activation operation of the non-evaporating getter having a thin Ti film was carried out simultaneously. The above heating was conducted under the condition of 300° C. and 10 hours, but the heating condition is not limited to this, and as far as adverse effects can be avoided, a heating processing at a higher temperature, needless to say, may lead to similar effects. Incidentally, even at a temperature of 300° C. or below, a longer duration of heating gave similar effects both in removing the benzonitrile and the decomposition substances therefrom and in activating the non-evaporating getter.

Process-n

The pressure was confirmed to be $1.3\times10^{-5}$ Pa or below, and then the gas evacuation pipe 21 was heated and sealed off using a burner.

Through all the processes described above, an image display unit of the present invention was fabricated.

Comparative Example 1

An image display unit similar to that in Example 1 was fabricated. The image display unit of the present Comparative Example was configured similarly to the image display unit shown in FIG. 2, but the non-evaporating getter of thin Ti film 10 was not arranged.

Comparative Example 2

An image display unit similar to that in Example 1 was fabricated. The image display unit of the present Comparative Example was configured similarly to the image display unit shown in FIG. 2, but had a configuration in which a commercial non-evaporating getter was arranged in place of the non-evaporating getter of thin Ti film 10.

Example 2

The present Example is different from Example 1 in that the non-evaporating getters of thin Ti film were formed both on the x-directional and y-directional wires.

The fabrication processes are common to those in Example 1 except that the following process-f-2 was performed in place of the process-f in Example 1.

Process-f-2

Metallic masks were prepared which have openings matched respectively to the x-directional wires (upper layer wires) and the y-directional wires (lower layer wires). Sufficiently careful positioning of the masks were made before the thin Ti films of about 2.5 μm in thickness were formed both on the x-directional wires (upper layer wires) and on the y-directional wires (lower layer wires). So that the surface roughness of the x-directional wires (upper layer wires) and that of the y-directional wires (lower layer wires) might have such a desired roughness as in Example 1, the silver wire material and the screen printing conditions were selected. Through the above described processes, the image display unit of the present Example was fabricated.

Example 3

The features of the present, Example are best shown in FIG. 3.

The present Example is different from Examples 1 and 2 in that the non-evaporating getters of thin Ti film were formed outside the image displaying region and both on the x-directional and y-directional wires inside the image displaying region.

In the present Example, the non-evaporating getters of thin Ti film were formed outside the image displaying region according to the process-f in Example 1, and furthermore, were made respectively on the x-directional and y-directional wires inside the image displaying region according to the process-f-2 of Example 2.

Comparative evaluation has been made on the image display units of Examples 1 to 3 and Comparative Examples 1 and 2.

In the evaluation, while a passive matrix driving was being carried out, and the image display unit was made to emit light continuously all over the phosphor screen, the time variation of the brightness was measured. The initial brightness varied with Examples, and the brightness decreased relatively and gradually with continued light emission. The features of brightness variation depended on the location of the pixel monitored, and the brightness degradation was fast and the brightness non-uniformity was large in the pixels in the neighborhood of the portions where the non-evaporating getters of thin Ti film 10 were not arranged. In particular, the brightness degradation was remarkable in Comparative Example 1, and the image display unit of Comparative Example 1 was inferior to, needless to say, those of Examples 1 to 3, and apparently to that of Comparative Example 2. Any of the image display units of Examples 1 to 3 was apparently lower in degree of degradation than the image display unit of Comparative Example 2, and was able to display high-quality images over a long period of time.

The present invention can provide a non-evaporating getter which can maintain the adsorbability for the residual gases, and in addition, can secure sufficient characteristics particularly even when it experiences a high-temperature and low-vacuum condition in the process of the display unit fabrication.

Additionally, the present invention can provide a non-evaporating getter having the above described performance by means of a dry and convenient method.

Yet additionally, the present invention can provide a display unit which incorporates a non-evaporating getter having the above described performance and excellent in displaying performance.

What is claimed is:

1. A non-evaporating getter wherein said getter comprises: (a) a substrate having no function as a getter, said substrate having concavities and convexities on the surface, wherein the convexities of said concavities and convexities have on average a height falling within the range from 0.2 μm to 20 μm and wherein an average pitch between convexities of said concavities and convexities falls within the range from 0.5 μm to 20 μm; and (b) polycrystalline film arranged on the substrate which film contains Ti as the main component and has a host of voids in the interior thereof.

2. A non-evaporating getter, wherein said getter comprises a substrate having no function as a getter and a polycrystalline film arranged on the substrate which film contains Ti as the main component and has a host of voids in the interior thereof, wherein the crystal grain size of said polycrystalline film falls within the range from 100 angstroms to 2000 angstroms.

3. The non-evaporating getter according to claim 1 wherein said polycrystalline film is composed of Ti.

4. A fabrication method of a non-evaporating getter comprising: forming a polycrystalline film having a host of voids in the interior thereof and containing Ti as the main component on a concavo-convex surface of a substrate which has concavities and convexities on the surface thereof and has no function as a getter, said convexities having on average a height falling within the range from 0.2 μm to 20 μm, and an average pitch between convexities of said concavities and convexities falls within the range from 0.5 μm to 20 μm.

5. The fabrication method of a non-evaporating getter according to claim 4 wherein said concavities and convexities are formed by sand blasting.

6. The fabrication method of a non-evaporating getter according to claim 4 wherein said concavities and convexities are formed by printing.

7. The fabrication method of a non-evaporating getter according to claim 4 wherein the formation of said polycrystalline film containing Ti as the main component is performed by sputtering.

8. A display unit which comprises electron sources and phosphors each opposing to one electron source in an envelope wherein the non-evaporating getter according to claim 1 is provided in said envelope.

9. A non-evaporating getter comprising: (a) a substrate having no function as a getter and having concavities and convexities on the surface thereof, wherein the average pitch between convexities of said concavities and convexities falls within the range from 0.5 μm to 20 μm; and (b) a polycrystalline film arranged on the substrate which film contains Ti as the main component and has a host of voids in the interior thereof.

10. The non-evaporating getter according to claim 2, wherein said polycrystalline film consists of Ti.

11. The non-evaporating getter according to claim 9, wherein said polycrystalline film consists of Ti.

12. A display device comprising an electron source and a phosphor disposed in opposition to said electron source within an envelope, characterized in that a non-evaporating getter according to claim 2, is disposed within said envelope.

13. A display device comprising an electron source and a phosphor disposed in opposition to said electron source within an envelope, characterized in that a non-evaporating getter according to claim 9, is disposed within said envelope.

* * * * *

UNITED STATES PATENT AND TRADEMARK OFFICE

CERTIFICATE OF CORRECTION

PATENT NO. : 6,784,613 B2
APPLICATION NO. : 10/219315
DATED : August 31, 2004
INVENTOR(S) : Masaki Tokioka et al.

It is certified that error appears in the above-identified patent and that said Letters Patent is hereby corrected as shown below:

ON THE TITLE PAGE [REFERENCES CITED]:

Foreign Patent Documents, "JP 2000-31588 11/2000" should read --JP 2000-311588 11/2000--.

ON THE TITLE PAGE [ABSTRACT]:

Lines 5-6, "unit. ¶ The" should read --unit. The--.

SHEET 4:

Figure 5, Sheet 4 of 6 should be replaced with the attached.

COLUMN 2:

Line 5, "a's" should read --as--.

Signed and Sealed this

Second Day of October, 2007

JON W. DUDAS
*Director of the United States Patent and Trademark Office*